US007224336B2

(12) United States Patent
Katsutani

(10) Patent No.: US 7,224,336 B2
(45) Date of Patent: May 29, 2007

(54) DISPLAY DEVICE DRIVE UNIT AND DRIVING METHOD OF DISPLAY DEVICE

(75) Inventor: Masafumi Katsutani, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 500 days.

(21) Appl. No.: 10/310,920

(22) Filed: Dec. 6, 2002

(65) Prior Publication Data

US 2003/0142051 A1 Jul. 31, 2003

(30) Foreign Application Priority Data

Jan. 25, 2002 (JP) ..... 2002-017595

(51) Int. Cl.
*G09G 3/36* (2006.01)
*G09G 5/00* (2006.01)

(52) U.S. Cl. ..... 345/87; 345/90; 345/95; 345/104; 345/204; 345/211; 345/212

(58) Field of Classification Search ..... 345/87–104, 345/204–212; 315/295–321
See application file for complete search history.

(56) References Cited

U.S. PATENT DOCUMENTS 4,891,743 A * 1/1990 May et al. ..... 363/87
5,463,286 A * 10/1995 D'Aleo et al. ..... 315/295
5,532,718 A 7/1996 Ishimaru
5,739,887 A 4/1998 Ueda et al.
5,874,931 A * 2/1999 Drake et al. ..... 345/51
6,078,318 A 6/2000 Mori et al.
6,181,313 B1 1/2001 Yokota et al.
6,275,207 B1 8/2001 Nitta et al.
6,313,982 B1 * 11/2001 Hino ..... 361/679
6,459,175 B1 * 10/2002 Potega ..... 307/149
6,891,427 B2 5/2005 Tsutsui et al.
6,937,216 B1 8/2005 Ishiyama
2002/0044142 A1 4/2002 Fukuda
2003/0067429 A1 4/2003 Aoki et al.

FOREIGN PATENT DOCUMENTS

JP 03-248122 11/1991
JP 04-305690 10/1992

(Continued)

*Primary Examiner*—Vijay Shankar
(74) *Attorney, Agent, or Firm*—Harness, Dickey & Pierce, P.L.C.

(57) ABSTRACT

The display device drive unit includes a liquid crystal driver that generates a liquid crystal driving voltage for display device driving, and can operate in a master mode for outputting the foregoing voltage and in a slave mode for driving the display device in accordance with the liquid crystal driving voltage that has been inputted from the outside. The display device drive unit further includes a selection register for storing mode information that indicates whether the liquid crystal drivers is set to be in the master mode or the slave mode, and the liquid crystal driver outputs the liquid crystal voltage when the mode information indicative of the master mode is stored, and stops outputting the foregoing voltage when the mode information indicative of the slave mode is stored. Thus, it is not necessary to provide a setting terminal for switching between the master mode and the slave mode, and it is also possible to switch between both the modes after the drive unit has been packaged in the display device.

7 Claims, 9 Drawing Sheets

FOREIGN PATENT DOCUMENTS

| | | |
|---|---|---|
| JP | 05-297827 | 11/1993 |
| JP | 06-095621 | 4/1994 |
| JP | 08-129354 | 5/1996 |
| JP | 09-022275 | 1/1997 |
| JP | 09-204154 | 8/1997 |
| JP | 10-062746 | 3/1998 |
| JP | 10-106254 | 4/1998 |
| JP | 11-015451 | 1/1999 |
| JP | 11-184434 | 7/1999 |
| JP | 2001-242834 | 9/2001 |
| JP | 2001-324967 | 11/2001 |
| JP | 2001-356744 | 12/2001 |

* cited by examiner

DISPLAY DEVICE DRIVE UNIT AND DRIVING METHOD OF DISPLAY DEVICE

FIELD OF THE INVENTION

The present invention relates to a display device drive unit that is applied to a drive unit of a liquid crystal panel for example, and relates to a driving method of a display device.

BACKGROUND OF THE INVENTION

A liquid crystal display device is provided with a liquid crystal driver for driving a liquid crystal panel for example. The liquid crystal driver generates a liquid crystal driving output, that drives the liquid crystal panel, from a liquid crystal driving voltage. As to the liquid crystal driver, the following conventional techniques are mainly applied, so as to obtain the liquid crystal driving voltage, according to purpose of use of the liquid crystal panel.

1. A technique in which liquid crystal driving voltages are provided to all the plurality of liquid crystal drivers from an external power source provided as a part of the liquid crystal driver.
2. A technique in which a voltage which functions also as a logic voltage is provided to the liquid crystal driver from a power source for logic driving so as to generate the liquid crystal driving voltage in the liquid crystal driver (note that, in a case where a voltage is generated by boosting the logic voltage, each liquid crystal driver includes a boosting circuit therein).
3. A technique in which a voltage which functions also as the logic voltage is provided to one of plural liquid crystal drivers, so as to generate the liquid crystal driving voltage in the liquid crystal driver, then providing the liquid crystal driving voltage to other liquid crystal drivers (note that, in a case where the liquid crystal driving voltage is generated by boosting the logic voltage, the corresponding liquid crystal driver includes a boosting circuit therein).

FIG. 7 shows an example of the foregoing prior art 1. A display device drive unit 101 shown in FIG. 7 is provided with a plurality of, for example, four liquid crystal drivers 103. A logic voltage of 3V for example and a liquid crystal driving voltage b of 15V for example are inputted from an external power source (not shown) to the liquid crystal drivers 103. Besides, a control signal c and a data signal d are inputted from a controller (not shown) to the liquid crystal drivers 103. Note that, description concerning a driver for driving a common electrode is omitted. The description is also omitted in FIG. 8 illustrating the prior art 2 and FIG. 9 illustrating the prior art 3.

In each liquid crystal driver 103, a liquid crystal driving output e of 0 to 15V for example is generated from the liquid crystal driving voltage b in accordance with resistance division etc. for example. The liquid crystal driving output e is outputted to the liquid crystal panel 102 in accordance with the control signal c and the data signal d. Thus, display is created in the liquid crystal panel 102 in accordance with the data signal d.

In the arrangement of the prior art 1, the liquid crystal driving voltage b is provided from the external power source, so that an extra circuit such as the boosting circuit is not required in the liquid crystal driver 103.

Next, FIG. 8 shows an example of the prior art 2. A display device drive unit 111 shown in FIG. 8 includes two liquid crystal drivers 112, and each of the liquid crystal drivers 112 has a boosting circuit 113 and a driving circuit 114. The logic voltage a of 3V for example is provided from a logic driving power source (not shown), which functions as an external power source, to each boosting circuit 113. Further, the control signal c and the data signal d are inputted from a controller 115 to the liquid crystal driver 112.

The boosting circuit 113 of the liquid crystal driver 112 generates the liquid crystal driving voltage b of 15V for example by boosting the logic voltage a of 3V for example, and the liquid crystal driving voltage b is outputted to a driving circuit 114. In the driving circuit 114, a liquid crystal driving output e of 0 to 15V for example is generated from the liquid crystal driving voltage b, and the liquid crystal driving output e is provided to the liquid crystal panel 102 in accordance with the control signal c and the data signal d.

In the display device driving unit 111, a dual scan mode based on a duty driving system using an STN liquid crystal is applied. In this case, a segment electrode of the liquid crystal panel 102 is divided into two electrodes (upper and lower electrodes), and there are provided the liquid crystal drivers 112 which drive the upper and lower electrodes respectively.

Next, FIG. 9 shows an example of the prior art 3. A display device driving unit 121 shown in FIG. 9 includes two liquid crystal drivers 122*a* and 122*b*, and each of the liquid crystal drivers 122*a* and 122*b* includes the boosting circuit 113 and the driving circuit 114. The logic voltage a of 3V for example is provided from the logic driving power source (not shown), that functions as an external power source, to each boosting circuit 113. Further, the control signal c and the data signal d are inputted from the controller 115 to the liquid crystal drivers 122*a* and 122*b*.

Each of the liquid crystal drivers 122*a* and 122*b* includes a setting terminal 123, and how voltages are provided to the liquid crystal drivers 122*a* and 122*b* varies depending on how the setting terminal 123 is set.

That is, the liquid crystal driver 122*a*, in which the setting terminal 123 is set to be High (logic power source voltage), allows the boosting circuit 113 to function. Thus, the logic voltage (3V) a is inputted to the liquid crystal driver 122*a*, so that the liquid crystal driving voltage (15V) b obtained by boosting the logic voltage a can be externally outputted.

While, the liquid crystal driver 122*b*, in which the setting terminal 123 is set to be Low (GND potential), does not allow the boosting circuit 113 to function. Thus, the liquid crystal driving voltage b is inputted from the outside to the liquid crystal driver 122*b*. Namely, the liquid crystal driving voltage b is inputted from the boosting circuit 113 of the liquid crystal driver 122*a* via a power feeder 124. The setting of the liquid crystal driver 122*a* is called "master mode", and the setting of the liquid crystal driver 122*b* is called "slave mode".

As described above, the liquid crystal driver 122*a* in the master mode generates the liquid crystal driving voltage b from the logic voltage a by means of the boosting circuit 113, and generates the liquid crystal driving output e from the liquid crystal driving voltage b by means of the driving circuit 114, so as to cause the liquid crystal panel 102 to create display in accordance with the liquid crystal driving output e. Further, the liquid crystal driving voltage b is outputted to the other liquid crystal driver 122*b*.

While, the liquid crystal driver 122*b* receives the liquid crystal driving voltage b from the liquid crystal driver 122*a* in the master mode, and generates the liquid crystal driving output e from the liquid crystal driving voltage b by means of the driving circuit 114, so as to cause the liquid crystal panel 102 to create display in accordance with the liquid crystal driving output e.

Note that, Japanese Unexamined Patent Publication No. 62746/1998 (Tokukaihei 10-62746)(Publication date: Mar. 6, 1998) discloses a similar technique, but it does not concern a power source. That is, this publication indicates a mode such that: a level shifter, which level-shifts an input signal of a vertical driver (corresponding to a common electrode driver) operating at a high voltage, is disposed only on a vertical driver in a master mode, and the input signal, outputted from the vertical driver in the master mode, that has been level-shifted, is received by a vertical driver in a slave mode.

It is general that the liquid crystal panel driven by the liquid crystal driver is under a loading condition in terms of capacity, so that it is necessary to charge and discharge the liquid crystal panel. Thus, a power source of the liquid crystal panel is required to provide a large quantity of current according to variation of outputs. In a case where power supplying ability is insufficient, a power source voltage itself varies. As a result, a bad influence is exerted on display of the liquid crystal panel.

The prior art 1 has the following advantage: external power sources providing the liquid crystal driving voltages b are additionally provided on all the plurality of liquid crystal drivers 103, so that it is possible to provide a power source appropriate for a property of the liquid crystal panel 102.

However, it is necessary to provide the external power sources. This increases the cost, and brings about necessity to make rooms for packaging the power sources thereon.

The prior art 2 is such that: the respective liquid crystal drivers 112 include the boosting circuits 113 which function as the power sources, so that the boosting circuits 113 are dispersively provided on the respective liquid crystal drivers 112. Thus, the power supplying ability of the boosting circuit 113 may be a little. Further, this does not increase the cost unlike the case where additional power sources are packaged.

However, it is impossible to equalize output voltages of the individual boosting circuits 113, that is, the output voltages are different from each other. Thus, it is difficult to create high quality display in the liquid crystal panel 102. That is, although preferable results may be brought about by other display conditions and display properties, the following problem tends to be brought about: as to the liquid crystal panel 102, in a case where one liquid crystal driving voltage b is different from other liquid crystal driving voltage b by 10 mV when a uniformed image is displayed on the entire screen for example, human eyes recognize the difference. Thus, it is impossible to use the prior art 2 in the case where the uniformed image is displayed on the entire screen. Further, it is general that power consumption of the boosting circuit 113 is large. Thus, when the boosting circuit 113 is operated in the liquid crystal driver 112, the power consumption of the liquid crystal driver 112 is increased.

The prior art 3 is such that: the boosting circuit 113 which functions as the power source is operated in a single liquid crystal driver 112, and the liquid crystal driving voltage b obtained therefrom is provided to other liquid crystal driver 122*b*. Thus, it is possible to reduce the power consumption. Further, variation of the output voltage of the boosting circuit 113, that is, variation of the liquid crystal driving voltage b uniformly occurs in each of the liquid crystal drivers 122*a* and 122*b*. Thus, this brings about an advantage that uneven display brought about by the variation of the liquid crystal driving voltage b is hardly seen.

Particularly in a case where a liquid crystal panel for a cellular phone is operated in accordance with dual scan driving, the following arrangement is applied: The liquid crystal drivers are disposed along both ends (upper and lower ends in FIG. 9) of the liquid crystal panel 102 as shown in FIG. 9, and the one is used in the master mode to obtain the liquid crystal driving voltage b by boosting, and the other is used in the slave mode to receive the liquid crystal driving voltage b that has been generated in the master mode. In this case, there is an advantage that: it is possible to simplify the power source circuits in the entire system, and to reduce the number of the boosting circuits 113 which consume a large quantity of current, and to uniform the liquid crystal driving voltages b in the respective liquid crystal drivers.

Incidentally, the invention of the aforementioned Tokukaihei 10-62746 includes LSIs which are different from each other as a master chip and a slave ship, that is, an LSI having the boosting circuit 113 therein and an LSI having no boosting circuit 113 therein. In this case, it is necessary to form LSIs, different from each other in a circuit arrangement, that function as the liquid crystal drivers, so that this increases the cost. Then, there is provided the setting terminal 123, which is used to switch between the master mode and the slave mode as shown in FIG. 9, so that there is formed an LSI which can be switched between the master mode and the slave mode. Upon packaging the LSI on the liquid crystal panel 102, the setting terminal 123 is set (fixed) to a desired mode.

However, according to the arrangement in which the liquid crystal driver is set to be in the desired mode by means of the setting terminal 123, it is necessary to provide a signal wiring 125, setting the mode, that is connected to the setting terminal 123 upon packaging the liquid crystal driver (LSI). Alternately, in a plurality of packages of the liquid crystal driver (LSI), for example, in TCPs (tape carrier packages), it is necessary to prepare a setting terminal whose level is fixed to High level and a setting terminal whose level is fixed to low level in the wiring provided in the TCP. Thus, this increases the cost.

Further, in the foregoing arrangement, it is impossible to switch the power supplying mode (current supplying ability) once the liquid crystal driver (LSI) is packaged. Thus, in the case where the ability of the power source is insufficient corresponding to the display condition, it is impossible to switch the voltage supplying mode so as to exhibit the ability required in creating display. As a result, it is necessary to set the power source by estimating the maximum power consumption, so that this increases the cost.

SUMMARY OF THE INVENTION

The present invention was made to solve the foregoing problems, and its object is (a) to provide a display device drive unit whose liquid crystal driver does not require the setting terminal for switching between the master mode and the slave mode, and which enables the switching between both the modes after being packaged in the display device, and (b) to provide a driving method of the display device.

In order to achieve the foregoing object, the display device drive unit of the present invention includes a driving voltage output section such as a liquid crystal driver that generates a display device driving voltage for driving a display device, and drives the display device in accordance with the display device driving voltage, and is operable in accordance with (i) a master mode for outputting the display device driving voltage to outside and (ii) a slave mode for driving the display device based on the display device driving voltage that has been inputted from the outside, and the display device drive unit includes a mode storage section such as a selection register, being rewritable, that stores mode information that indicates whether the driving voltage output section is set to be in the master mode or the slave mode, wherein the driving voltage output section outputs the display device driving voltage when the mode information indicative of the master mode is stored in the mode storage section, and the driving voltage output section stops outputting the display device driving voltage when the mode information indicative of the slave mode is stored in the mode storage section.

According to the arrangement, the driving voltage section does not require the setting terminal used to set the master mode or the slave mode, so that it is not necessary to provide a signal wire connected to the setting terminal. That is, in the display device drive unit of the present invention, the mode storage section is provided on the driving voltage output section instead of the mode setting terminal, and it is possible to write the mode information stored in the mode storage section in accordance with a control signal and a data signal, using a signal line, that are conventionally inputted from a controller to the driving voltage output section (such as a liquid crystal driver) for example. Thus, it is possible to reduce the cost.

Further, an operation mode of the driving voltage output section is changed between the master mode and the slave mode by rewriting the mode information stored in the mode storage section, so that it is possible to readily change the operation mode after packaging the display device drive unit in the display device. Thus, it is not necessary to prepare a plurality of packages corresponding to the respective operation modes in advance, so that it is possible to reduce the cost.

Further, it is possible to change the operation mode of the driving voltage output section after packaging the display device drive unit in the display device as described above. Thus, the operation mode of the driving voltage output section is changed as required according to a using condition of the display device drive unit, for example, according to a display condition of the display device, so that it is possible to create preferable display while avoiding insufficient power supply, and it is possible to realize an operation at lower power consumption.

For a fuller understanding of the nature and advantages of the invention, reference should be made to the ensuing detailed description taken in conjunction with the accompanying drawings.

DESCRIPTION OF THE EMBODIMENTS

One embodiment of the present invention is described as follows based on FIG. 1 through FIG. 6.

The present embodiment is an example where the display device drive unit of the present invention is applied to a liquid crystal display device, and shows a case of dual scan mode based on a duty driving system using an STN liquid crystal panel.

Figure 1:
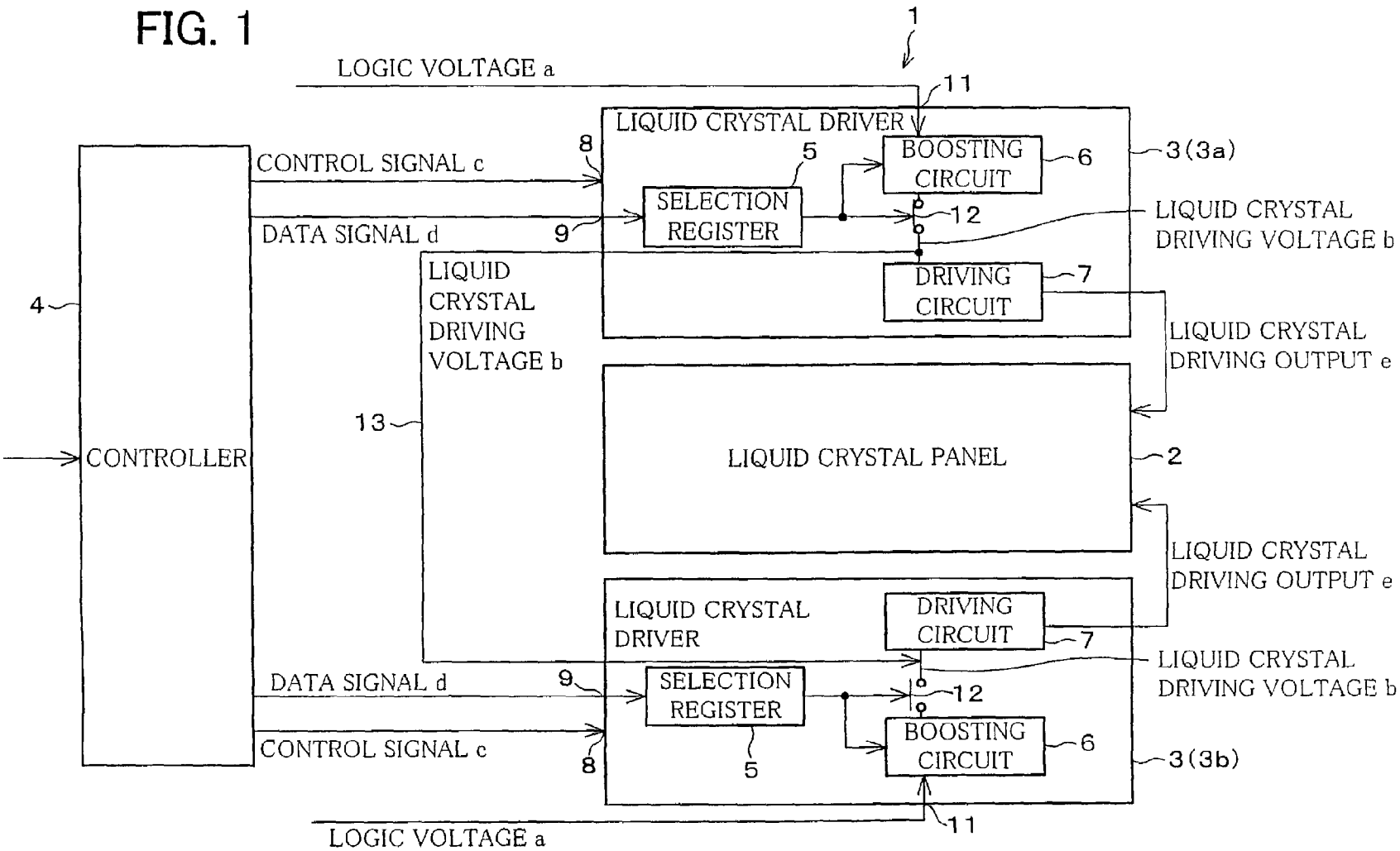
FIG. 1 is a block diagram showing an arrangement of a display device drive unit of one embodiment of the present invention.

FIG. 1 shows a basic arrangement of a display device drive unit 1. As shown in FIG. 1, the display device drive unit 1 is to drive a liquid crystal panel 2 as a display device, and includes a plurality of liquid crystal drivers (driving voltage outputting means) 3 and a controller 4. In the present embodiment, two liquid crystal drivers 3 are provided. Each of the liquid crystal drivers 3 has a selection register (mode storage means) 5, a boosting circuit 6, and a driving circuit 7.

A control signal c is inputted from the controller 4 via a control signal input terminal 8 to the liquid crystal driver 3, and a data signal d is inputted from the controller 4 via a data signal input terminal 9 connected to an input side of the selection register 5 to the liquid crystal driver 3. Further, a logic voltage a of 3V for example is inputted from a logic driving power source (not shown), which functions as an external power source, via a logic voltage input terminal 11 connected to an input side of the boosting circuit 6 to the liquid crystal driver 3.

A switch 12 for switching ON/OFF is provided between an output side of the boosting circuit 6 and an input side of the driving circuit 7. ON/OFF of the switch 12 and activation/non-activation of the boosting circuit 6 are controlled in accordance with an output from the selection register 5 (corresponding to setting of the selection register 5). Further, the input sides of the driving circuits 7 provided on both the liquid crystal drivers 3 are connected to each other via a feeder 13.

The boosting circuit 6 generates the liquid crystal driving voltage (display device driving voltage) b of 15V for example by boosting the logic voltage a of 3V for example. The driving circuit 7 generates the liquid crystal driving output e of 0 to 15V for example from the liquid crystal driving voltage b of 15V for example in accordance with resistance division etc., and the liquid crystal driving output e is outputted to the liquid crystal panel 2 so as to create display.

A setting value of a master mode or a slave mode is stored in the selection register 5 in accordance with the control signal c and the data signal d from the controller 4. Note that, under a condition shown in FIG. 1, a setting value of the master mode is stored in the selection register 5 of one liquid crystal driver 3, and a setting value of the slave mode is stored in the selection register 5 of the other liquid crystal driver 3.

The arrangement of the display device drive unit 1 is further detailed as follows.

The controller 4 is connected to an external microcomputer MPU (not shown) via a system bass, and inputs/outputs a controller control signal from the microcomputer, and inputs a display data signal. The controller 4 receives the controller control signal from the microcomputer. In accordance with the control signal, the controller 4 outputs the display data signal d in synchronism with two liquid crystal drivers 3 for driving segments electrodes positioned upward and downward with respect to the liquid crystal panel. When the liquid crystal driver 3 receives the data signal d, the data signal d is stored in a display RAM (not shown) provided therein.

Further, the controller 4 outputs various kinds of control signal c (for example, operation clock, data latch signal, horizontal synchronization signal, alternating signal or start pulse signal, and the like), that control the liquid crystal driver 3, to the liquid crystal driver 3. The liquid crystal driver 3 receives the control signal c via the control signal input terminal 8.

In accordance with the data signal c that has been received via the control signal input terminal 8 and the data signal d that has been received via the data signal input terminal 9, the selection register 5 of the liquid crystal driver 3 stores the setting value for setting the liquid crystal driver 3 in the master mode or the slave mode. The selection register 5 includes simple circuits such as D type flip flops whose amount is the same as the number of bits for example.

The boosting circuit 6 includes a known charge pump circuit and the like for example. The boosting circuit 6 performs a boosting operation with respect to the inputted voltage by receiving a clock for charge pump, and stops the boosting operation when the clock stops entering.

Figure 2:
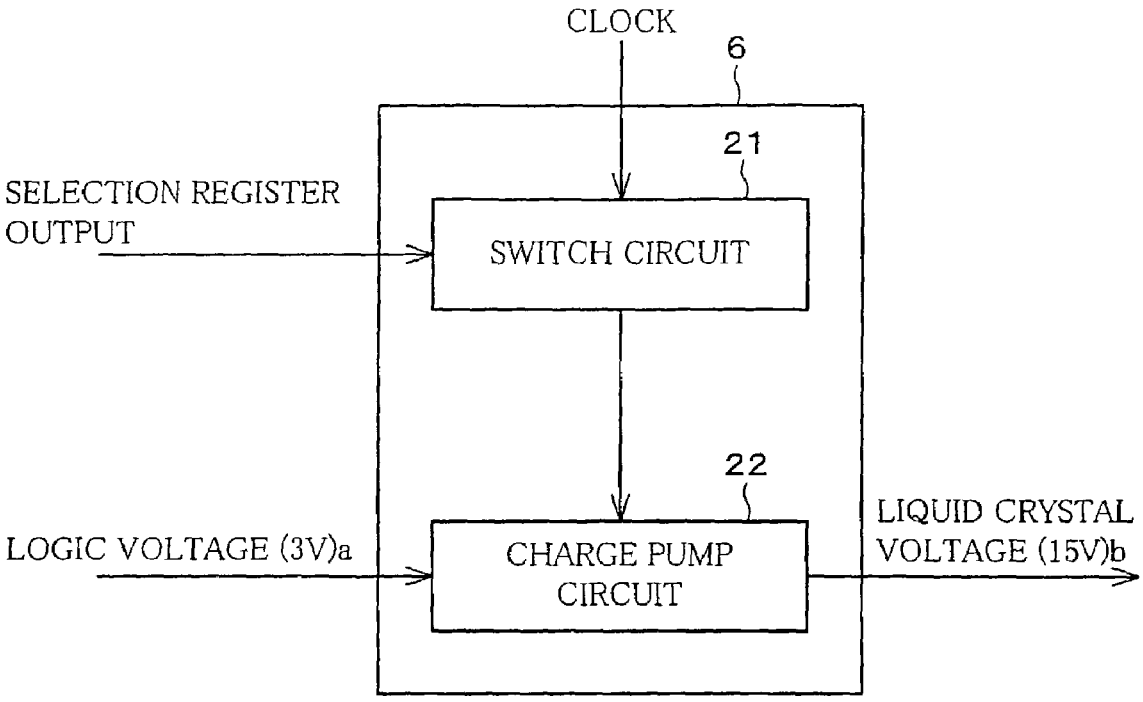
FIG. 2 is a block diagram showing an arrangement of a boosting circuit shown in FIG. 1.

A switch circuit for switching operation/stop of the boosting circuit 6 includes an analog switch circuit constituted of a MOS transistor and the like for example. Thus, the boosting circuit 6 includes a charge pump circuit 21 and a switch circuit 22 as shown in FIG. 2 for example. In this case, the switch circuit 22 inputs the clock for charge pump to the charge pump circuit 21 when the setting value of the master mode is stored in the selection register 5, and forbids or stops the clock for charge pump from being inputted to the charge pump circuit 21 when the setting value of the slave mode is stored in the selection register 5.

Further, in the liquid crystal driver 3, corresponding to a case where the setting of the selection register 5 is in the slave mode or a case where the setting of the selection register 5 is in the master mode, an opening/closing operation of the switch 12 (it is opened in the slave mode and closed in the master mode) between the boosting circuit 6 and the driving circuit 7. Note that, instead of the switch 12, there may be provided means for making an output stage of the boosting circuit 6 high impedance in the case of the slave mode.

Figure 3:
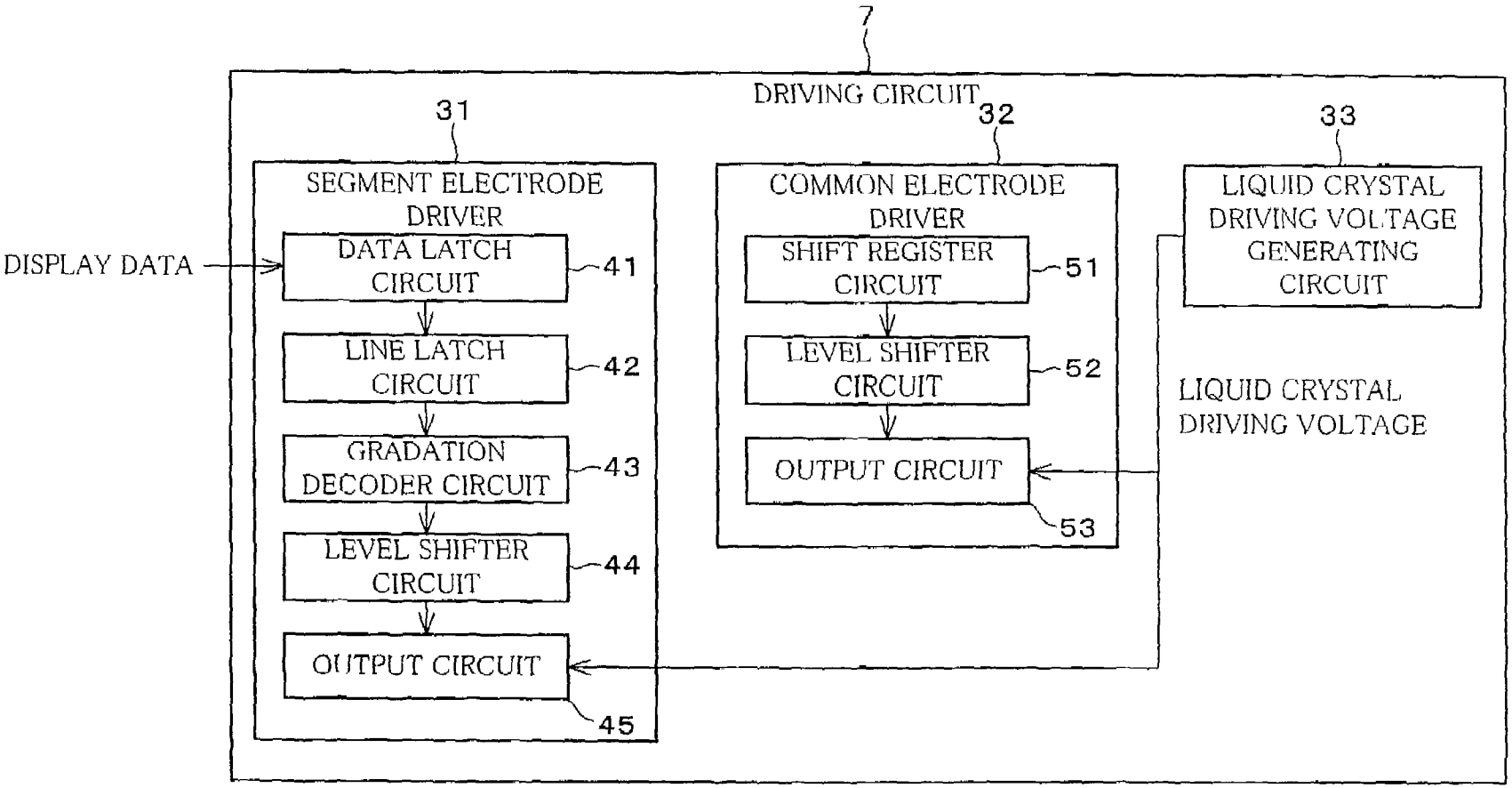
FIG. 3 is a block diagram showing an arrangement of a driving circuit shown in FIG. 1.

The driving circuit 7 includes a segment electrode driver 31, a common electrode driver 32, and a liquid crystal driving voltage generating circuit 33 as shown in FIG. 3. The segment electrode driver 31 includes: a data latch circuit 41 for latching the data signal d that has been outputted from the display RAM; a line latch circuit 42 for latching the data signal d during one horizontal synchronization period; a gradation decoder circuit 43 for selecting a pulse width corresponding to the data signal d so as to create gradation display in accordance with a pulse width modulation mode; a level shifter circuit 44 for boosting an output signal level of the gradation decoder circuit 43 to the maximum liquid crystal driving voltage level (15V in this case); and an output circuit 45 for making an output signal of the level shifter circuit 44 low impedance so as to output the output signal.

While, the common electrode driver 32 is to output a scanning signal to the liquid crystal panel 2, and includes: a shift register circuit 51; a level shifter circuit 52 for boosting an output level of the shift register circuit 51 to the maximum liquid crystal driving voltage level (15V in this case); and an output circuit 53 for making an output signal (scanning signal) of the shift register circuit 52 low impedance so as to output the output signal to the each common electrode of the liquid crystal panel 2.

Here, the data latch circuit 41 of the segment electrode driver 31, the line latch circuit 42, and the gradation decoder circuit 43 are driven in accordance with the logic voltage a (3V in this case) provided from the logic driving power source, and the level shifter circuit 44 and the output circuit 45 are driven in accordance with the maximum liquid crystal driving voltage. While, the shift register circuit 51 of the common electrode driver 32 is driven in accordance with the logic voltage a (3V in this case), and the level shifter circuit 52 and the output circuit 53 are driven in accordance with the maximum liquid crystal driving voltage (15V in this case). Further, the liquid crystal driving voltage generating circuit 33 includes a plurality of resistors connected to each other in series for example, and receives the maximum liquid crystal driving voltage (15V in this case), and generates voltages (V0, V1, V2, V3, V4, and V5), required in driving liquid crystal, in accordance with divisional resistance.

According to the arrangement, operation/no-operation of the boosting circuit 6 is switched in accordance with the setting of the selection register 5. In a case where the operation of the boosting circuit 6, that is, a predetermined setting value for causing the boosting circuit 6 to perform the boosting operation is set in the selection register 5, the liquid crystal driver 3 having the boosting circuit 6 is in the master mode. In this case, the boosting circuit 6 boosts the inputted logic voltage a of 3V for example so as to generate the liquid crystal driving voltage b of 15V for example, and the switch 12 is turned ON. Thus, the generated liquid crystal driving voltage b is outputted to the driving circuit 7 and is externally outputted, that is, outputted to the other liquid crystal driver 3.

The driving circuit 7 that has received the liquid crystal driving voltage b generates the liquid crystal driving output e of 0 to 15V for example from the liquid crystal driving voltage b of 15V for example, so that the liquid crystal driving output e causes the liquid crystal panel 2 to create display.

While, in a case where the non-operation of the boosting circuit 6, that is, a predetermined setting value for causing the boosting circuit 6 to stop the boosting operation is set in the selection register 5, the liquid crystal driver 3 having the boosting circuit 6 is in the slave mode. In this case, the boosting circuit 6 stops boosting the logic voltage a, and the switch 12 is turned OFF. Thus, the liquid crystal driver 3 receives the liquid crystal driving voltage b from the outside, that is, from the liquid crystal driver 3 in the master mode for example.

In the liquid crystal driver 3 that has received the liquid crystal driving voltage b, in the same manner as in the foregoing operation, the driving circuit 7 generates the liquid crystal driving output e of 0 to 15V for example from the liquid crystal driving voltage b of 15V for example, so that the liquid crystal driving output e causes the liquid crystal panel 2 to create display.

Figure 9:
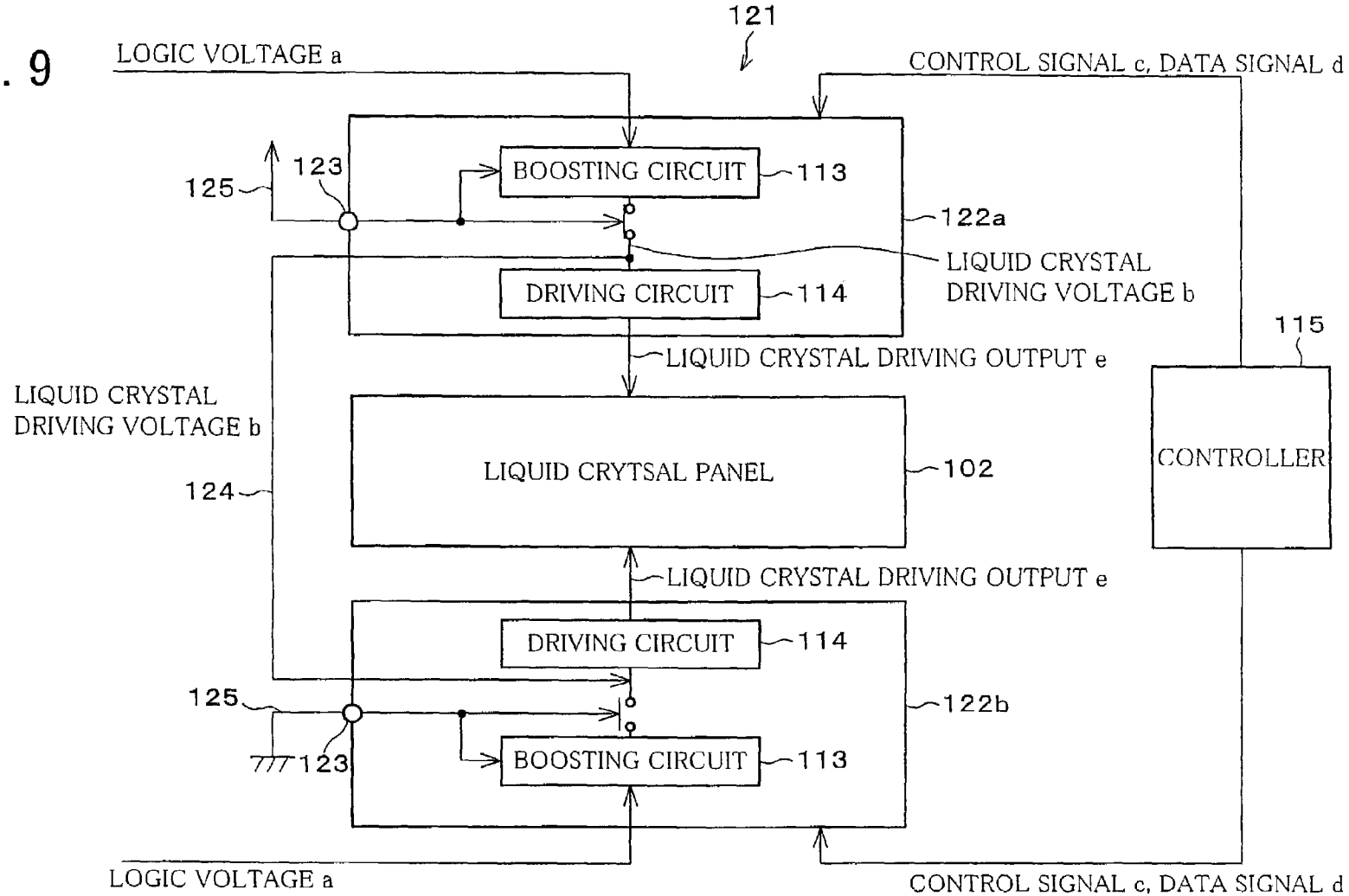
FIG. 9 is a block diagram showing an arrangement of still another conventional display device drive unit.

The setting value is written in the selection register 5 in accordance with the control signal c and the data signal d that are provided from the controller 4. In an example shown in FIG. 1 concerning the display device drive unit 1, the one liquid crystal driver 3 (3*a*: upper side in the figure) is set to be in the master mode, and the other liquid crystal driver 3 (3*b*: lower side in the figure) is set to be in the slave mode. This condition is the same as in the aforementioned display device drive unit 121 shown in FIG. 9. However, the display device drive unit 1 is different from the display device drive unit 121 in that the setting terminal 121 is not required. As to terminals other than this, both the display device drive units 1 and 121 are arranged in the same manner.

As described above, the display device drive unit 1 does not require the setting terminal 123, so that a mode setting signal wire 125, that is connected to the setting terminal 123 upon packaging the liquid crystal driver (LSI), is not required. Thus, it is possible to reduce the cost.

Further, in the display device drive unit 1, the setting value of the selection register 5 is changed, so that it is possible to change a mode of the liquid crystal driver 3 having the selection register 5 between the master mode and the slave mode. Thus, also after the liquid crystal driver 3 constituted of LSI for example is packaged on the liquid crystal display device, it is possible to change the mode. Thus, in a plurality of packages functioning as the liquid crystal driver 3 (LSI) in the master mode and the slave mode, for example, in TCPs, it is not necessary to prepare a setting terminal whose level is fixed to High level and a setting terminal whose level is fixed to Low level in the wiring provided in the TCP. Thus, it is possible to reduce the cost.

Figure 6:
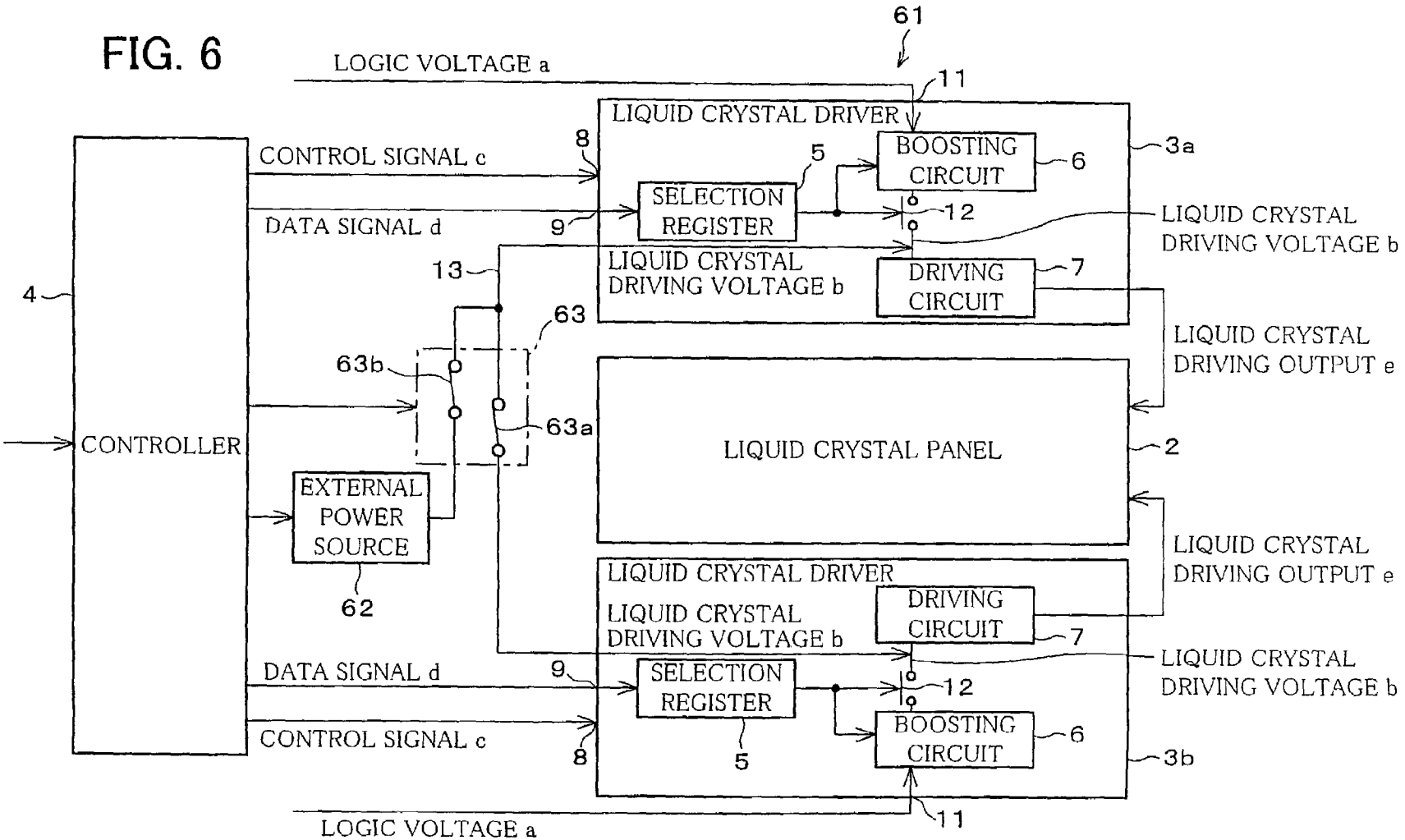
FIG. 6 illustrates the display device drive unit shown in FIG. 4, and functions as a block diagram showing a case where all the liquid crystal drivers are in the slave mode.
Figure 7:
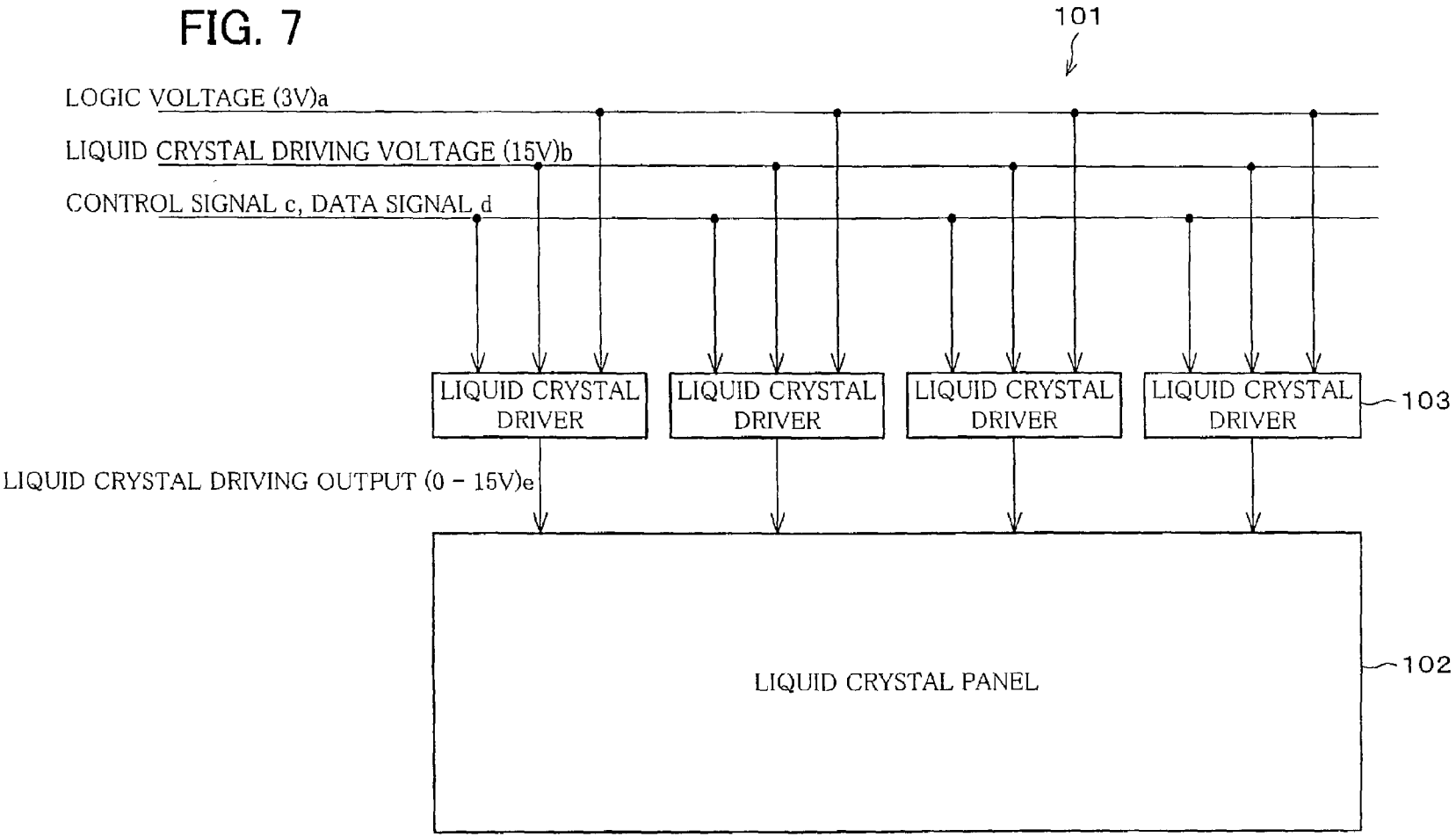
FIG. 7 is a block diagram showing an arrangement of a conventional display device drive unit.
Figure 8:
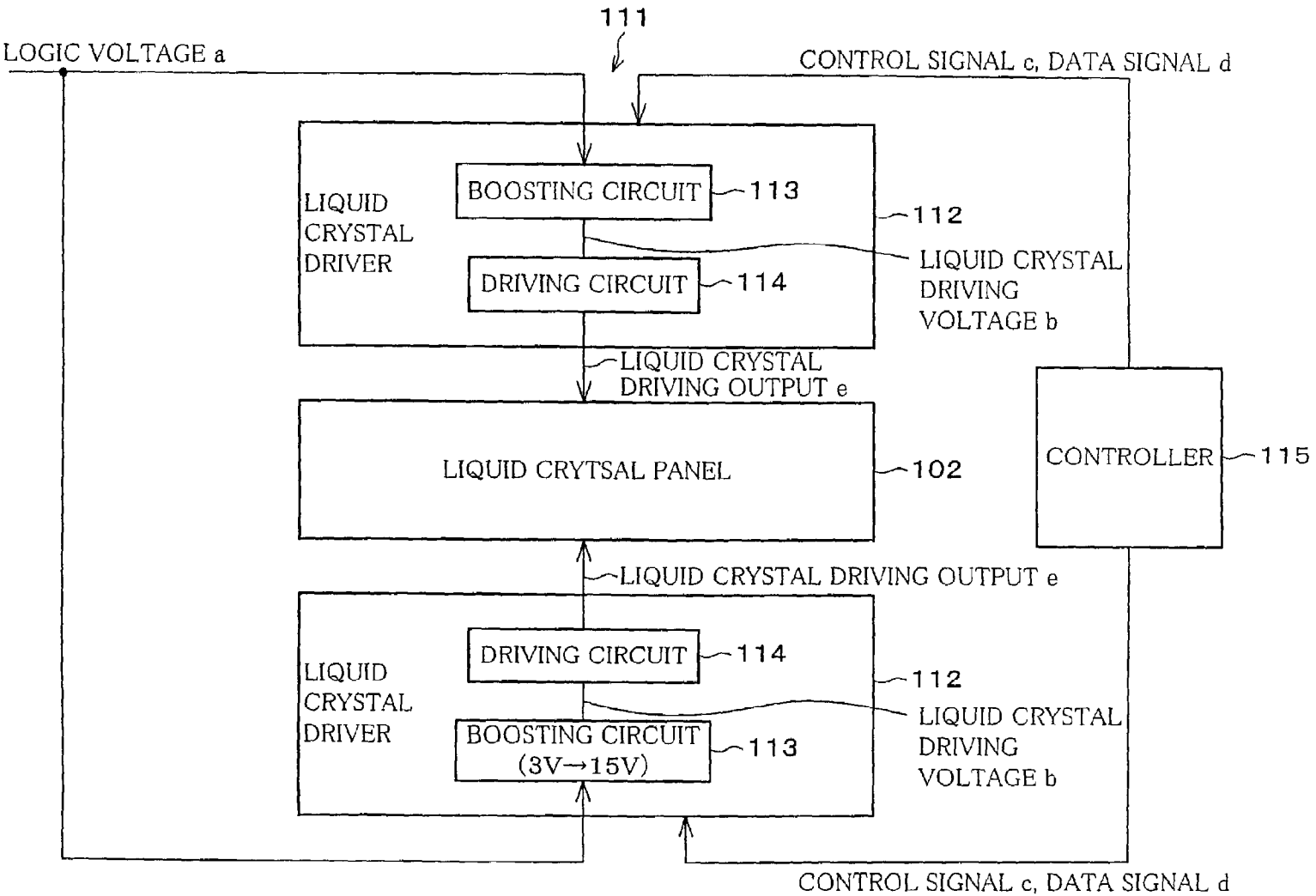
FIG. 8 is a block diagram showing another arrangement of a conventional display device drive unit.

In the display device drive unit 1, also after the liquid crystal driver 3 is packaged in the liquid crystal display device, it is possible to change the mode of the liquid crystal driver 3 between the master mode and the slave mode as described above. Thus, as shown in FIG. 6 through FIG. 8, it is also possible to arrange the display device drive unit 1 so as to form a display device drive unit 61 (see FIG. 4) which further includes: an external power source (power source which outputs a voltage of 15V in this case) 62; and a control switch (switching means) 63. Note that, in the display device drive unit 61, the one of the two liquid crystal drivers 3 is indicated as "liquid crystal driver 3*a*" and the other is indicated as "liquid crystal driver 3*b*" so as to distinguish the liquid crystal drivers 3 from each other.

The control switch 63 includes first and second switches 63*a* and 63*b*. The first switch 63*a* is provided on the feeder 13, and performs electrical connection/disconnection of the feeder 13. The second switch 63*b* is provided between the feeder 13 and the external power source 62, and electrically connects/disconnects the external power source to/from the feeder 13.

The control switch 63 is constituted of an analog switch such as a MOS transistor, and performs ON/OFF operation by being controlled by the controller 4. The control switch 63 may be externally provided, or may be provided in the controller 4, or may be provided in either the liquid crystal driver 3*a* or the liquid crystal driver 3*b*.

The operation of the external power source 62 (constituted of a power source circuit for example) is controlled by the controller 4. That is, the external power source 62 operates only when it is used, and stops operating when it is not used, so that it is possible to reduce the power consumption.

In the display device drive unit 61, it is possible to perform the following (1) to (3) operations.

(1) In a case where the liquid crystal panel 2 is highly fine, its load-carrying capacity required to be large due to its large quantity of pixels and large screen. Then, in a case where the liquid crystal panel is not highly fine, or in a case where high-speed switching is not required in the liquid crystal panel 2 (in a case where a still image or a slow-moving image is displayed in the liquid crystal panel 2), it is judged that the current supplying ability of the power source may be small. In this case, any one of the liquid crystal drivers 3*a* and 3*b* (a plurality of liquid crystal drivers 3) is in the mater mode, and other liquid crystal drivers 3 are in the slave mode, so that the number of the operating boosting circuits 6 can be reduced. Thus, it is possible to reduce the power consumption.

Figure 4:
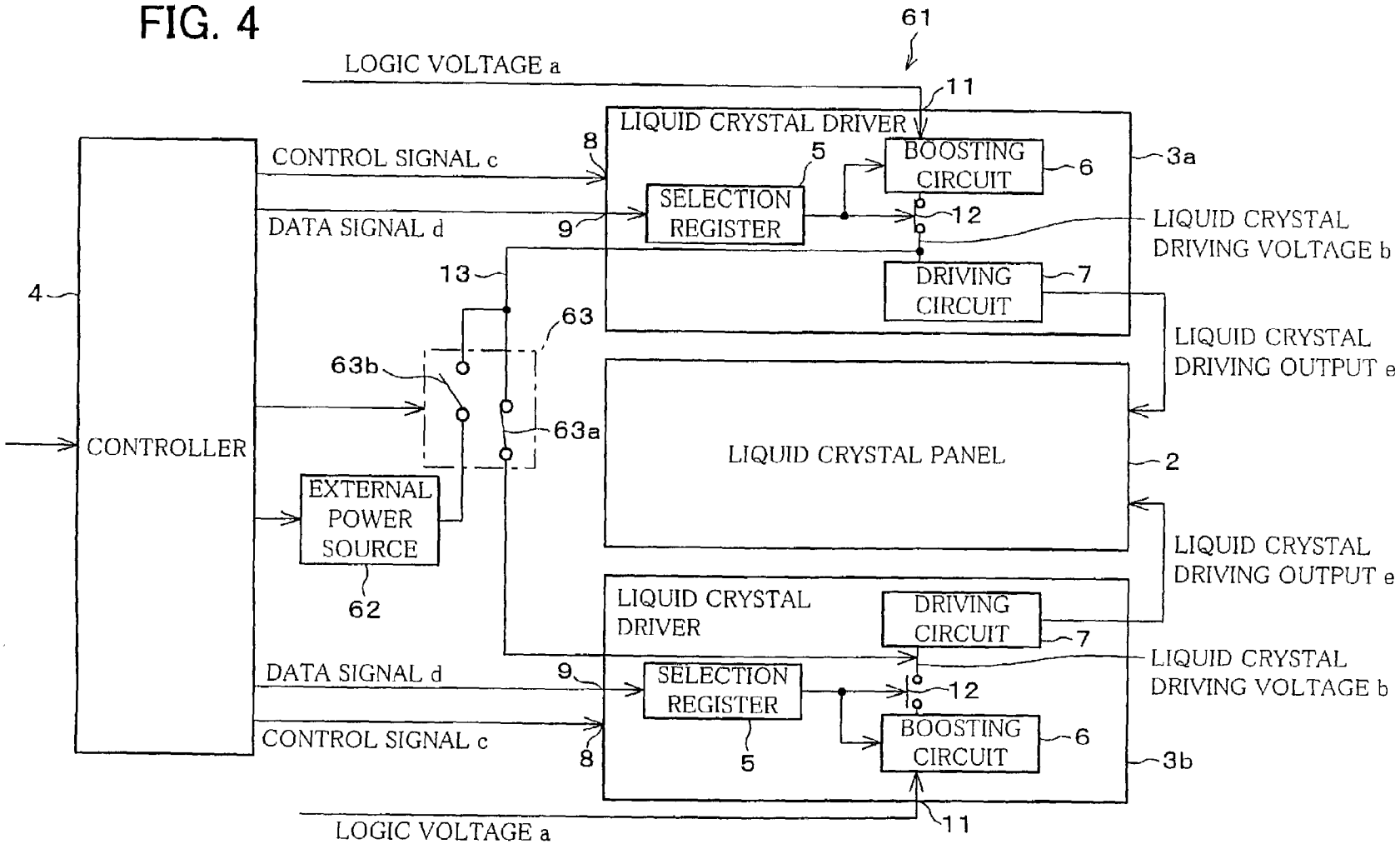
FIG. 4 illustrates a display device drive unit according to another example of the display device drive unit shown in FIG. 1, and functions as a block diagram showing a case where one liquid crystal driver is in a master mode and another liquid crystal driver is in a slave mode.

FIG. 4 shows a condition of the display device drive unit 61 in this case. Under the condition of FIG. 4, the liquid crystal driver 3*a* is set to be in the master mode, and the liquid crystal driver 3*b* is set to be in the slave mode. Thus, the boosting circuit 6 operates in the liquid crystal driver 3*a*, so as to generate the liquid crystal driving voltage b (15V for example) by boosting the logic voltage a (3V for example). The liquid crystal driving voltage b is provided via the switch 12, which is turned ON, to the driving circuit 7, and is provided to the feeder 13. The driving circuit 7 generates the liquid crystal driving output e (0 to 15V for example) from the liquid crystal driving voltage b, so as to drive the liquid crystal panel 2.

The control switch 63 is controlled by the controller 4 so that the first switch 63*a* is turned ON and the second switch 63*b* is turned OFF. Thus, the liquid crystal driving voltage b that has been outputted from the liquid crystal driver 3*a* to the feeder 13 is provided to the input side of the driving circuit 7 of the liquid crystal driver 3*b*. Further, the external power source 62 does not operate, and the second switch 63*b* is made OFF.

Since the liquid crystal driver 3*b* is in the slave mode, the boosting circuit 6 does not operate, and the switch 12 is turned OFF. Thus, the driving circuit 7 of the liquid crystal driver 3*b* generates the liquid crystal driving output e from the liquid crystal driving voltage b that has been provided from the liquid crystal driver 3*a*, so as to drive the liquid crystal panel 2.

(2) In a case where the liquid crystal panel 2 is highly fine, or in a case where high-speed switching is required in the liquid crystal panel 2, it is necessary to enlarge the current supplying ability of the power source. While, also in a case where dispersion occurs between the liquid crystal driving output e outputted from the liquid crystal driver 3*a* and the liquid crystal driving output e outputted from the liquid crystal driver 3, it is sometimes judged that there is no problem as to a certain kind of a display image. In this case, all the liquid crystal drivers 3*a* and 3*b* may be in the master mode. In this case, the boosting circuit 6, which functions as a liquid crystal driving voltage generator, operates in each of the liquid crystal drivers 3*a* and 3*b*, so that the load can be shared by the liquid crystal drivers 3*a* and 3*b*.

Figure 5:
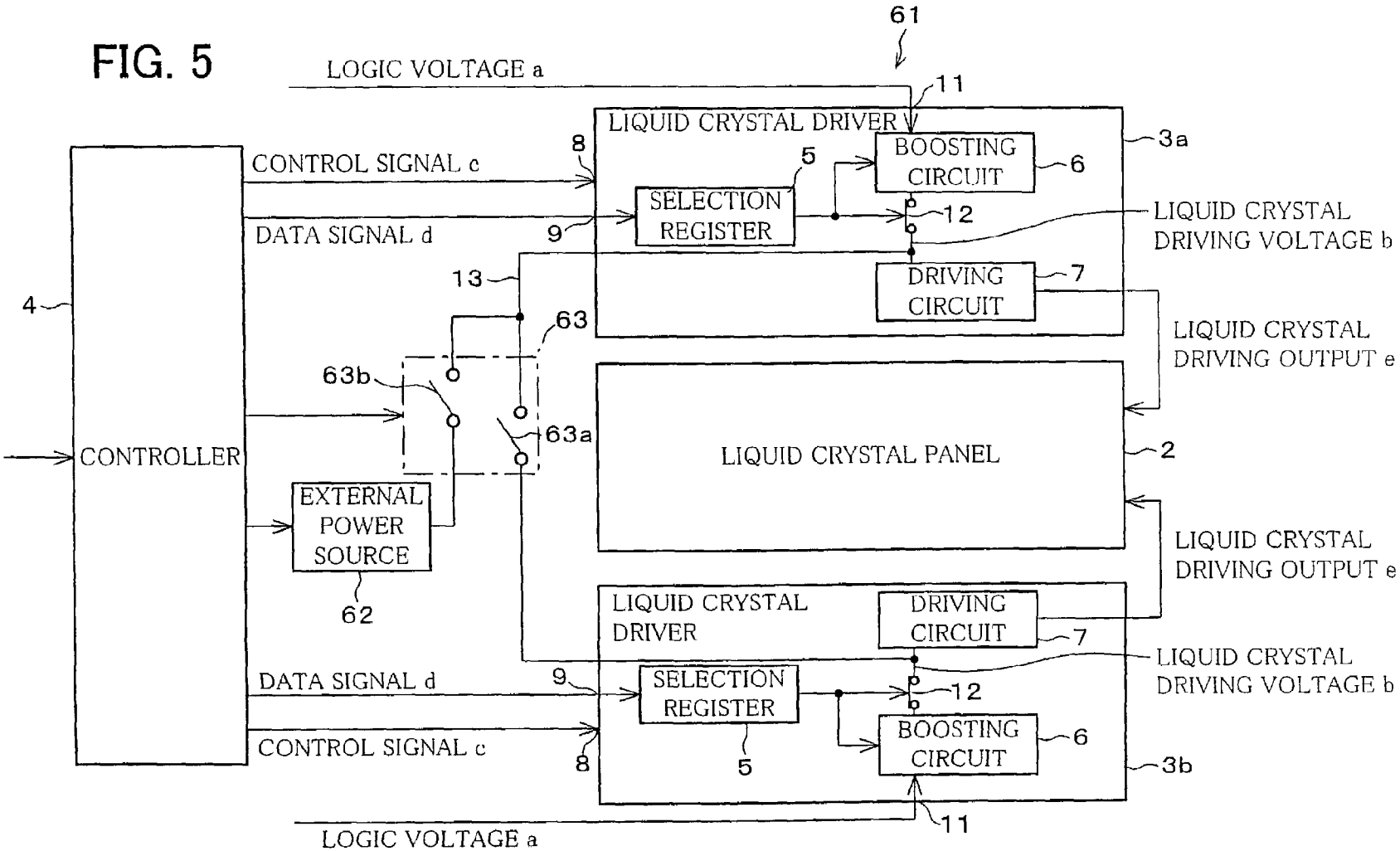
FIG. 5 illustrates the display device drive unit shown in FIG. 4, and functions as a block diagram showing a case where all the liquid crystal drivers are in the master mode.

FIG. 5 shows a condition of the display device drive unit 61 in this case. The condition (2) (condition shown in FIG. 5) is such that: the load can be shared by the liquid crystal drivers 3*a* and 3*b* in the arrangement of the display device drive unit 61 having the liquid crystal drivers 3*a* and 3*b* as described above, so that the current supplying ability under the condition (2) is twice compared with the condition (1) (condition shown in FIG. 4).

Under the condition of FIG. 5, both the liquid crystal drivers 3*a* and 3*b* are in the master mode. Thus, in each of the liquid crystal drivers 3*a* and 3*b*, the boosting circuit 6 operates so as to generate the liquid crystal driving voltage b (15V for example) by boosting the logic voltage a (3V for example). The liquid crystal driving voltage b is provided to the driving circuit 7 via the switch 12 which is turned ON, and is provided to the feeder 13. The driving circuit 7 of each of the liquid crystal drivers 3*a* and 3*b* generates the liquid crystal driving output e (0 to 15V) from the liquid crystal driving voltage b, so as to drive the liquid crystal panel 2.

In a case where it is not preferable that the driving voltage outputs of the boosting circuits 6 of the liquid crystal drivers 3*a* and 3*b* are connected to each other, as shown in FIG. 5, also the first switch 63*a* of the control switch 63 is turned OFF. Further, the external power source 62 does not operate, and also the second switch 63*b* is turned OFF.

(3) In a case where the liquid crystal panel 2 is highly fine, or in a case where high-speed switching is required in the liquid crystal panel 2, it is necessary to enlarge the current supplying ability of the power source. Besides, in a case where dispersion occurs between the liquid crystal driving output e outputted from the liquid crystal driver 3*a* and the liquid crystal driving output e outputted from the liquid crystal driver 3, it is sometimes judged that there is no problem as to a certain kind of a display image. In this case, all the liquid crystal drivers 3*a* and 3*b* are in the slave mode, and stable and uniformed voltages are provided from the external power source 62 to the liquid crystal drivers 3*a* and 3*b*, so that the high quality display is realized in the liquid crystal panel 2.

In this case, the external power source 62 has the current supplying ability larger than that of the boosting circuit 6. Note that, the external power source 62 may be arranged so that it is possible to switch a plurality of current supplying abilities for example.

FIG. 6 shows a condition of the display device drive unit 61 in this case. Under the condition of FIG. 6, both the liquid crystal drivers 3*a* and 3*b* are in the slave mode. Thus, in each of the liquid crystal drivers 3*a* and 3*b*, the boosting circuit 6 does not operate, and receives the liquid crystal driving voltage b from the outside of the liquid crystal drivers 3*a* and 3*b*. Further, both the switches 12 are turned OFF.

While, in the control switch 63, both the first and second switches 63*a* and 63*b* are turned ON, and the external power source 62 operates. Thus, the liquid crystal driving voltages b are provided from the external power source 62 to the driving circuits 7 of the liquid crystal drivers 3*a* and 3*b* via the feeder 13. Then, in each of the driving circuits 7, the liquid crystal driving output e is generated from the liquid crystal driving voltage b, so as to drive the liquid crystal panel 2.

Note that, it is possible to readily apply the arrangements of the display device drive units 1 and 61 to a liquid crystal driver of TFT system. This is effective for a display device, having boosting means therein, that generates a gradation display voltage so as to create display.

Further, each of the display device drive units 1 and 61 may be packaged on a casing frame (periclinal portion) of the liquid crystal panel in the form of a TCP, or may be connected to a terminal (ITO) on the casing frame of the liquid crystal panel via an anisotropic conductive film so as to be fixed in the form of a COG (chip-on glass).

As to the display device drive units 1 and 61, the case where there are provided two liquid crystal drivers 3 (each of the liquid crystal drivers 3 is provided on each of both ends of the liquid crystal panel 2) is shown, but the foregoing arrangement can be applied to an arrangement in which three or more liquid crystal drivers 3 are connected to each other in cascade corresponding to a large quantity of electrodes so as to realize a large screen or a highly fine image. In this case, it is possible to perform the setting so that any one of, or a plurality of liquid crystal drivers 3 is in the master mode.

Further, in a case where display is created not in the entire screen of the liquid crystal panel 2, but in a part of the screen in the form of a window, it is possible to perform the following operation when movie display is partially created or a still image is switched to/from the movie display. That is, the liquid crystal driver 3, corresponding to an electrode portion whose charging/discharging amount with respect to a pixel capacitor of the liquid crystal panel 2 is large, is in the master mode, or the liquid crystal driver 3, corresponding to an electrode portion whose charging/discharging amount with respect to the pixel capacitor of the liquid crystal panel is small, is in the slave mode, while the liquid crystal driving voltage b is being provided from the external power source 62 to the liquid crystal driver 3. Thus, it is possible to realize higher display quality and lower power consumption at the same time.

According to the arrangement of the present invention, the switching terminal for performing the switching between the master mode and the slave mode is not required, so that it is not necessary to provide the switching terminal upon packaging. Thus, it is possible to reduce a packaging area. Further, a device in the master mode and a device in the slave mode can be provided in a single package, so that it is possible to reduce the cost.

Further, it is possible to select a more appropriate power supplying method according to a display condition. Thus, for example, there are provided a plurality of power sources having appropriate power supplying ability, and the power sources are switched as required, so that it is possible to realize a display device which brings about lower power consumption and higher display quality.

As described above, the display device drive unit of the present invention may be arranged so that: a plurality of the driving voltage output means have output sections, and the output sections, each of which allows a display device driving voltage to be outputted via each of the output sections, are connected to each other so that the display device driving voltage outputted from one of the driving voltage output means is usable in the other of the driving voltage output means.

According to the arrangement, mode information is written in respective mode storage means provided corresponding to the respective driving voltage output means, and any one of the driving voltage output means is in the master mode, and another driving voltage output means is in the slave mode, so that the display device driving voltage can be provided from the driving voltage output means in the master mode to the driving voltage output means in the slave mode. In this manner, the display device driving voltage is generated by the minimum number of driving voltage output means when there are a plurality of driving voltage output means, so that it is possible to reduce the power consumption.

This operation is suitable for the case where the large current supplying ability is not required (the case where the power consumption is small), such as the case where the display screen is not highly fine, and the case where high-speed switching is not required in the display screen (the case where a still image or a slow-moving image is displayed in the display screen).

Further, it is possible to perform the operation such that all the driving voltage output means are in the master mode. In this case, the display device driving voltage is generated by the driving voltage output means, so that the load can be shared by the respective driving voltage output means.

This operation is suitable for the case where there is no problem as to a certain kind of a display image even though dispersion occurs between the respective driving voltage output means.

The display device drive unit of the present invention may be arranged so that: each of the output sections, provided on the driving voltage output means, that outputs the display device driving voltage, is connected via switching means to an external power source for providing the display device driving voltage.

According to the arrangement, it is possible to realize (a) the operation such that: any one of the plural driving voltage output means is in the master mode, and other driving voltage output means are in the slave mode, and (b) the operation such that all the driving voltage output means are in the master mode. In addition to this, it is possible to realize the operation such that: all the driving voltage output means are in the slave mode, and the display device driving voltage is provided from the external power source to the output section of the driving voltage output means. In this case, stable and uniformed voltages are provided from the external power source to all the driving voltage output means, so that it is possible to create high quality display in the display screen.

This operation is suitable for the case where it is necessary to enlarge the current supplying ability of the power source, such as (a) the case where the display screen is highly fine, and (b) the case where high-speed switching is required in the display screen.

The aforementioned display device drive unit may be arranged so as to include: the external power source for providing the display device driving voltage; a feeder for connecting output sections, provided on the driving voltage output means, each of which allows the display device driving voltage to be outputted via each of the output sections; and switching means, provided between the feeder and the external power source, which allows the driving voltage output means in the slave mode to selectively connect to the driving voltage output means in the master mode or to the external power source.

According to the arrangement, the driving voltage output means in the slave mode can select either the driving voltage output means in the master mode or the external power source as a source of the display device driving voltage in accordance with (a) whether the highly fine display is required or not and (b) whether or not the large current supplying ability is required in terms of the switching speed of the display screen.

The method of the present invention for driving the display is arranged so as to include the steps of: generating a display device driving voltage for driving the display device; driving the display device in accordance with the display device driving voltage; using the display device drive unit having (i) a plurality of driving voltage output means that are operable in accordance with a master mode for outputting the display device driving voltage to outside and a slave mode for driving the display device on the display device driving voltage inputted from the outside, (ii) mode storage means, being rewritable, that stores mode information that indicates whether each of the driving voltage output means is set to be in the master mode or the slave mode; setting all the driving voltage output means in the slave mode in accordance with the mode information stored in the mode storage means so as to provide the display device driving voltage from the external power source to the driving voltage output means.

According to the arrangement, the mode information indicative of the slave mode is written in all the mode storage means corresponding to the respective driving voltage output means, so that all the driving voltage output means are set to be in the slave mode, and the display device driving voltage is provided to the driving voltage output means from the external power source. In this case, stable and uniformed voltages are provided to all the driving voltage output means from the external power source, so that it is possible to create high quality display in the display screen.

This operation is suitable for the case where the large current supplying ability is required, such as the case where the display screen is highly fine, and the case where the high-speed switching is required in the display screen.

The method of the present invention for driving the display device is arranged so as to include the steps of: generating a display device driving voltage for driving the display device; driving the display device in accordance with the display device driving voltage; using the display device drive unit having (i) a plurality of driving voltage output means that are operable in accordance with a master mode for outputting the display device driving voltage to outside and a slave mode for driving the display device based on the display device driving voltage inputted from the outside, (ii) mode storage means, being rewritable, that stores mode information that indicates whether each of the driving voltage output means is set to be in the master mode or the slave mode; setting at least any one of the driving voltage output means in the master mode in accordance with the mode information stored in the mode storage means; setting other driving voltage output means in the slave mode so as to provide the display device driving voltage from the driving voltage output means in the master mode to the driving voltage output means in the slave mode.

According to the arrangement, the mode information is written in the respective mode storage means corresponding to the respective driving voltage output means for example, so that at least any one of the driving voltage output means is set to be in the master mode according to the display condition of the display screen for example, and other driving voltage output means are set to be in the slave mode, and the display device driving voltage is provided from the driving voltage output means in the master mode to the driving voltage output means in the slave mode.

In this case, the display device driving voltage can be generated by the minimum number of driving voltage output means when there are a plurality of driving voltage output means, so that it is possible to reduce the power consumption.

This operation is suitable for the case where the large current supplying ability is not required (the case where the power consumption is small), such as the case where the display screen is not highly fine, and the case where high-speed switching is not required in the display screen (the case where a still image or a slow-moving image is displayed in the display screen).

The method of the present invention for driving the display device is arranged so as to include the steps of: generating a display device driving voltage for driving the display device; driving the display device in accordance with the display device driving voltage; using the display device drive unit having (i) a plurality of driving voltage output means that are operable in accordance with a master mode for outputting the display device driving voltage to outside and a slave mode for driving the display device based on the display device driving voltage inputted from the outside, (ii) mode storage means, being rewritable, that stores mode information that indicates whether each of the driving voltage output means is set to be in the master mode or the slave mode; and causing the driving voltage output means to switch between the master mode and the slave mode by rewriting the mode information stored in the mode storage means.

According to the arrangement, the mode information stored in the respective mode storage means corresponding to the respective driving voltage output means is rewritten for example, so that the driving voltage output means is switched between the master mode and the slave mode according to the display condition in the display screen for example.

Thus, the respective driving voltage output means can operate in the most appropriate operation mode according to the display condition in the display screen and the required current supplying ability.

The method of the present invention for driving the display device is arranged so as to include the steps of: generating a display device driving voltage for driving the display device; driving the display device in accordance with the display device driving voltage; using the display device drive unit having (i) a plurality of driving voltage output means that are operable in accordance with a master mode for outputting the display device driving voltage to outside and a slave mode for driving the display device based on the display device driving voltage inputted from the outside, (ii) mode storage means, being rewritable, that stores mode information that indicates whether each of the driving voltage output means is set to be in the master mode or the slave mode; setting at least any one of the driving voltage output means in the slave mode in accordance with the mode information stored in the mode storage means so as to provide the display device driving voltage from the driving voltage output means in the master mode or the external power source to the driving voltage output means in the slave mode.

According to the arrangement, the mode information stored in the respective mode storage means corresponding to the respective driving voltage output means is rewritten for example, so that at least any one of the driving voltage output means is set to be in the slave mode according to the display condition of the display screen, and the display device driving voltage is provided from the driving voltage output means in the master mode or the external power source to the driving voltage output means in the slave mode.

Thus, the respective driving voltage output means can operate in the most appropriate operation mode according to the display condition of the display screen and the required current supplying ability.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A display device drive unit, comprising:

driving voltage output means configured to generate a display device driving voltage for driving a display device and operable in accordance with (i) a master mode for outputting the display device driving voltage to outside, and (ii) a slave mode for driving the display device based on the display device driving voltage that has been inputted from the outside;

mode storage means, being rewritable, and configured to store mode information that indicates whether the driving voltage output means is set to be in the master mode or the slave mode, wherein the driving voltage output means outputs the display device driving voltage when mode information indicative of the master mode is stored in the mode storage means, and stops outputting the display device driving voltage when mode information indicative of the slave mode is stored in the mode storage means:

an external power source for providing the display device driving voltage;

a feeder for connecting the output sections of the plurality of driving voltage output means to each other; and switching means arranged between the feeder and the external power source and configured to selectively connect the driving voltage output means in the slave mode to the driving voltage output means in the master mode or to the external power source, wherein a plurality of said driving voltage output means have output sections for outputting the display device driving voltage, and each of the output sections are connected to each other so that the display device driving voltage outputted from one of the driving voltage output means is usable in other driving voltage output means.

2. A display device drive unit, comprising:

driving voltage output means configured to generate a display device driving voltage for driving a display device and operable in accordance with (i) a master mode for outputting the display device driving voltage to outside, and (ii) a slave mode for driving the display device based on the display device driving voltage that has been inputted from the outside, and mode storage means, being rewritable, and configured to store mode information that indicates whether the driving voltage output means is set to be in the master mode or the slave mode, wherein the driving voltage output means outputs the display device driving voltage when mode information indicative of the master mode is stored in the mode storage means, and stops outputting the display device driving voltage when mode information indicative of the slave mode is stored in the mode storage means, wherein a plurality of said driving voltage output means have output sections for outputting the display device driving voltage, and each of the output sections are connected to each other so that the display device driving voltage outputted from one of the driving voltage output means is usable in other driving voltage output means, wherein each of the mode storage means is provided on each of the driving voltage output means and wherein each pair of the mode storage means and the driving voltage output means is provided on a periclinal portion of the display device in a form of a tape carrier package.

3. A display device drive unit, comprising: driving voltage output means configured to generate a display device driving voltage for driving a display device and operable in accordance with (i) a master mode for outputting the display device driving voltage to outside, and (ii) a slave mode for driving the display device based on the display device driving voltage that has been inputted from the outside, and mode storage means, being rewritable, and configured to store mode information that indicates whether the driving voltage output means is set to be in the master mode or the slave mode, wherein the driving voltage output means outputs the display device driving voltage when mode information indicative of the master mode is stored in the mode storage means, and stops outputting the display device driving voltage when mode information indicative of the slave mode is stored in the mode storage means, wherein a plurality of said driving voltage output means have output sections for outputting the display device driving voltage, and each of the output sections are connected to each other so that the display device driving voltage outputted from one of the driving voltage output means is usable in other driving voltage output means, wherein each of the mode storage means is provided on each of the driving voltage output means and wherein each pair of the mode storage means and the driving voltage output means is provided on a periclinal portion of the display device in a form of a chip-on glass.

4. A display device drive unit for driving a liquid crystal panel, comprising:

a plurality of liquid crystal drivers configured to generate a driving voltage for driving the liquid crystal panel and operable in accordance with (i) a master mode for generating the driving voltage locally to drive the liquid crystal panel, and (ii) a slave mode for driving the liquid crystal based on a driving voltage that has been received from an external source, and a plurality of selection registers, each corresponding to a given liquid crystal driver and configured to store mode information related to whether its corresponding liquid crystal driver is set to be in the master mode or slave mode, wherein a given liquid crystal driver outputs a driving voltage if mode information indicative of the master mode is stored in its corresponding register, and terminates outputting the driving voltage if mode information indicative of the slave mode is stored in its corresponding register.

5. The display device drive unit of claim 4, wherein each of the plurality of liquid crystal drivers have output sections for outputting the driving voltage, and each of the output sections are connected to each other so that the driving voltage output from a given liquid crystal driver is usable in one or more other liquid crystal drivers.

6. The display device drive unit of claim 5, wherein each of the output sections is connected via a switch to an external power source for providing the driving voltage.

7. The display device drive unit of claim 5, further comprising:

an external power source for supplying the driving voltage;

a feeder for connecting the output sections of the plurality of liquid crystal drivers to each other; and a switch unit arranged between the feeder and the external power source and configured to selectively connect one or more liquid crystal drivers in the slave mode to a given liquid crystal driver in the master mode or to the external power source.

* * * * *